US007621831B2

(12) United States Patent
Roberts

(10) Patent No.: US 7,621,831 B2
(45) Date of Patent: Nov. 24, 2009

(54) PORTABLE PITCHING MOUND

(76) Inventor: Cliff Lee Roberts, 8191 SW. Freeway #116, Houston, TX (US) 77074

( * ) Notice: Subject to any disclaimer, the term of this patent is extended or adjusted under 35 U.S.C. 154(b) by 442 days.

(21) Appl. No.: 11/595,690

(22) Filed: Nov. 10, 2006

(65) Prior Publication Data

US 2007/0117660 A1 May 24, 2007

(51) Int. Cl.
*A63B 71/00* (2006.01)

(52) U.S. Cl. ..... 473/497; D21/780

(58) Field of Classification Search ..... 473/451, 473/476–484, 497; D21/700, 701, 702–705, D21/780
See application file for complete search history.

(56) References Cited

U.S. PATENT DOCUMENTS

| | | | | | |
|---|---|---|---|---|---|
| 1,129,776 | A | * | 2/1915 | Anthony | 280/43.11 |
| 1,435,609 | A | * | 11/1922 | Kelly | 280/11 |
| 1,884,636 | A | * | 10/1932 | Faus | 280/43.14 |
| 2,379,446 | A | * | 7/1945 | Krueger | 182/178.1 |
| 4,063,729 | A | | 12/1977 | Hollaway | |
| 4,216,933 | A | * | 8/1980 | Cramer, Jr. | 248/188.5 |
| D258,903 | S | | 4/1981 | Goeders | |
| 4,306,718 | A | | 12/1981 | Goeders | |
| 4,561,653 | A | | 12/1985 | Wright | |
| 4,749,223 | A | | 6/1988 | Goeders | |
| 4,934,720 | A | * | 6/1990 | Dobron | 280/79.11 |
| D315,382 | S | | 3/1991 | Ragsdale | |
| 5,058,889 | A | | 10/1991 | Burton | |
| 5,213,323 | A | | 5/1993 | Novinsky | |
| D338,248 | S | | 8/1993 | Beck | |
| 5,467,977 | A | * | 11/1995 | Beck | 473/497 |
| 5,624,112 | A | | 4/1997 | Hummel et al. | |
| D388,849 | S | | 1/1998 | Goeders | |
| 5,707,305 | A | | 1/1998 | Goeders et al. | |
| 6,843,739 | B2 | * | 1/2005 | Putnam | 473/497 |
| 6,863,155 | B2 | * | 3/2005 | Wyse et al. | 182/118 |

OTHER PUBLICATIONS

NPL,DIY-Pitching Mound, Apr. 29, 2005, http://web.archive.org/web/20050429002801/http://www.diynetwork.com/diy/hi_sports_additions/article/0,2037,DIY_13931_2278306,00.html,5 pages.*

* cited by examiner

*Primary Examiner*—Gene Kim
*Assistant Examiner*—Mike Chambers

(57) ABSTRACT

The present invention provides a portable pitching mound for use indoors or outdoors. The portable pitching mound has a height setting mechanism and a plurality of wheels for portability. The portable pitching mound is comprised of a supported base frame unit with an anti-sink device that supports a non-collapsible and non-removable single downward sloping ramp section, the surface of which is covered with artificial turf and contains a conventional pitching rubber. The portable pitching mound has a height setting mechanism that allows the mound to adjust to different heights or slopes to comply with the official baseball rules regarding the height of the mound. Wheel connection features allow for easy portability without any disassembly of the ramp or framed unit. A utility handle pull is also attached to assist in the rolling of the mound on the two wheels provided.

2 Claims, 7 Drawing Sheets

PORTABLE PITCHING MOUND

BACKGROUND OF THE INVENTION

The present invention relates generally to training or practice equipment for baseball pitchers of all ages. More particularly, the present invention relates to a solid single ramped portable pitching mound for use indoors or outdoors that has a height adjustment capability and wheel connection capability for easy transport.

When practicing baseball pitching, it is important for the player to be able to simulate the conditions normally faced in game situations. This allows the player to be "comfortable" when the game situation is forthcoming. Official Baseball regulations dictate the required height of a mound depending on the League and these rules are subject to change. Generally, the height requirements of the mound change when a player reaches a certain league. By way of example, the current rules dictate that Little League players (who are generally 12 years old and younger) are to pitch from a mound that is six inches high and after Little League (for players 13 years old and up) the mound height rules dictate a ten inch height. It is therefore, extremely important that a practice pitching mound have a height adjusting capability in order to correctly simulate the exact height requirement of the mound in order to accommodate players of all Leagues and ages.

In addition, weather prevents actual outdoor field practice on occasion. Therefore, a portable pitching mound that can be used indoors becomes necessary. In addition, many outdoor fields or yards do not have a "regulation bull pen" mound for the pitchers to warm-up on and therefore, need an outdoor portable pitching mound.

Prior art workers have devised many different types of portable pitching mounds. For example, U.S. Pat. Nos. 6,843,739, 5,707,305, 5,213,323 and 5,058,889. For the most part such mounds have multiple sections with collapsible, interlocking, or detachable parts and do not have any Height adjustment mechanisms. Only U.S. Pat. No. 6,843,739 has a height adjustment mechanism but even it is on a unit that has a "collapsible ramp" constructed of multiple individual ramp sections and it does not have any wheel connections for portability. As a matter of fact, none of these other mounds have any wheels for portability.

BRIEF SUMMARY OF THE INVENTION

The present invention solves each of the above-mentioned difficulties by providing a solid single ramped portable pitching mound that is height adjustable with wheels for easy portability that can be used indoors or outdoors.

The primary object of this invention is to provide an improved portable pitching mound.

A further object of this invention is to provide a portable pitching mound that is readily height adjustable to conform to the applicable rules depending on the league so as to accommodate any age player.

A further object of this invention is to provide a portable pitching mound that includes a wheel connection for easy portability.

A further object of this invention is to provide a portable pitching mound that does not require multiple platform sections for assembly or disassembly.

The present invention overcomes problems in the prior art and others.

The present invention provides a portable pitching mound for use indoors or outdoors. The portable pitching mound is comprised of a supported base frame unit with an anti-sink device that supports a non-collapsible and non-removable single downward sloping ramp section, the surface of which is covered with artificial turf and contains a conventional pitching rubber. The portable pitching mound has a height adjustment mechanism that allows the mound to adjust to different heights and slopes to comply with the official baseball rules regarding the height of the mound. Wheel connection features allow for easy portability without any disassembly of the ramp or framed unit. A utility handle pull is also attached to assist in the rolling of the mound on the two wheels provided.

The above objectives and further objectives of, details and advantages of this invention will become more apparent from the following detailed description when read in conjunction with the accompanying drawings.

DETAILED DESCRIPTION OF THE PREFERRED EMBODIMENT(S)

Figure 1:
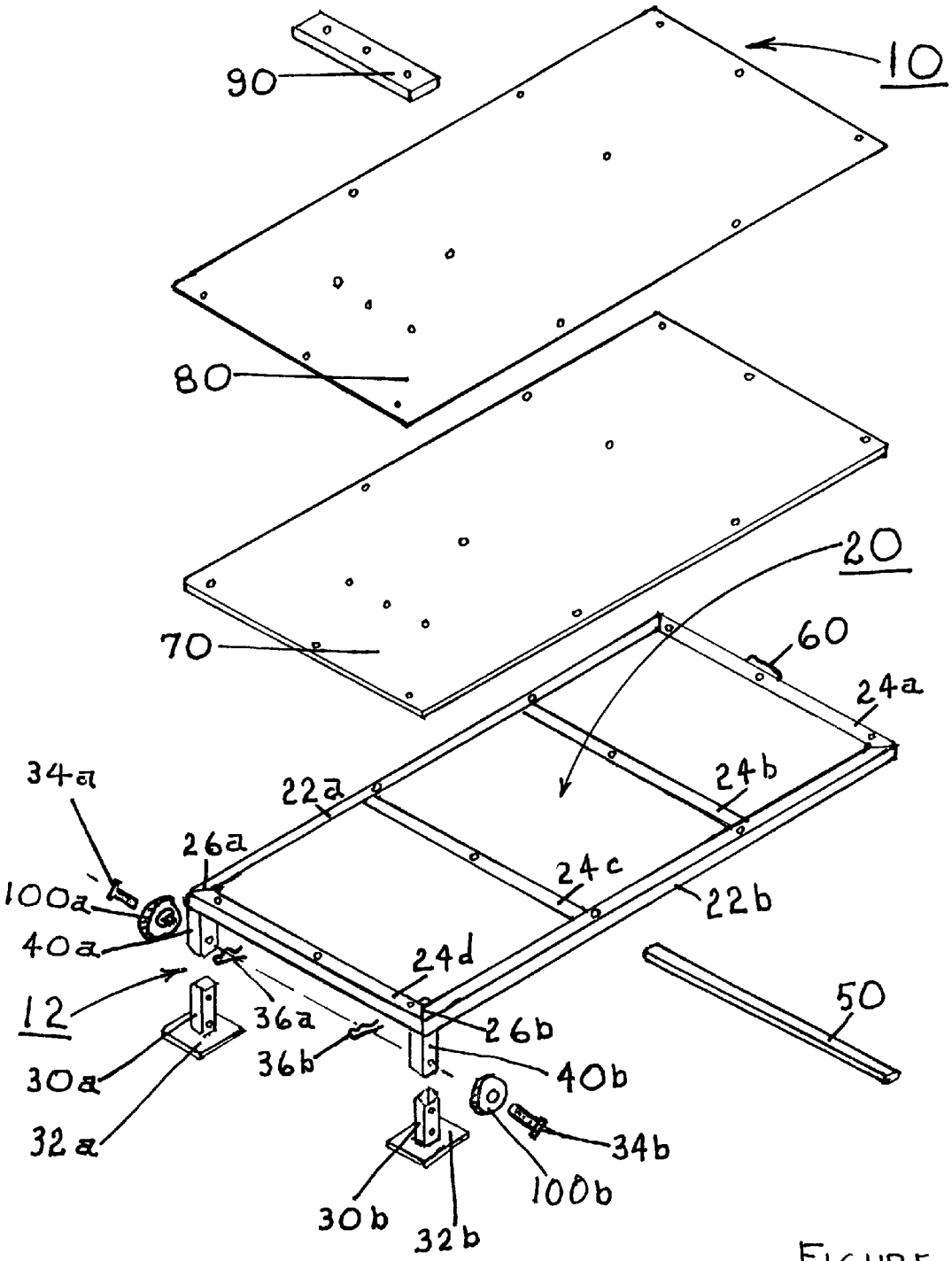
FIG. 1 is an exploded perspective view of one embodiment.

Referring to FIGS. 1-5 a portable indoor-outdoor pitching mound 10 is shown composed of a frame 20 with a height and slope setting mechanism 12 that allows the mound 10 to adjust to different heights and slopes. The pitching mound 10 may be made with many various components, arrangements, and sizes. The figures represented in the drawings illustrate the preferred apparatus and method(s) but are not to be construed as limiting the claims.

Figure 2:
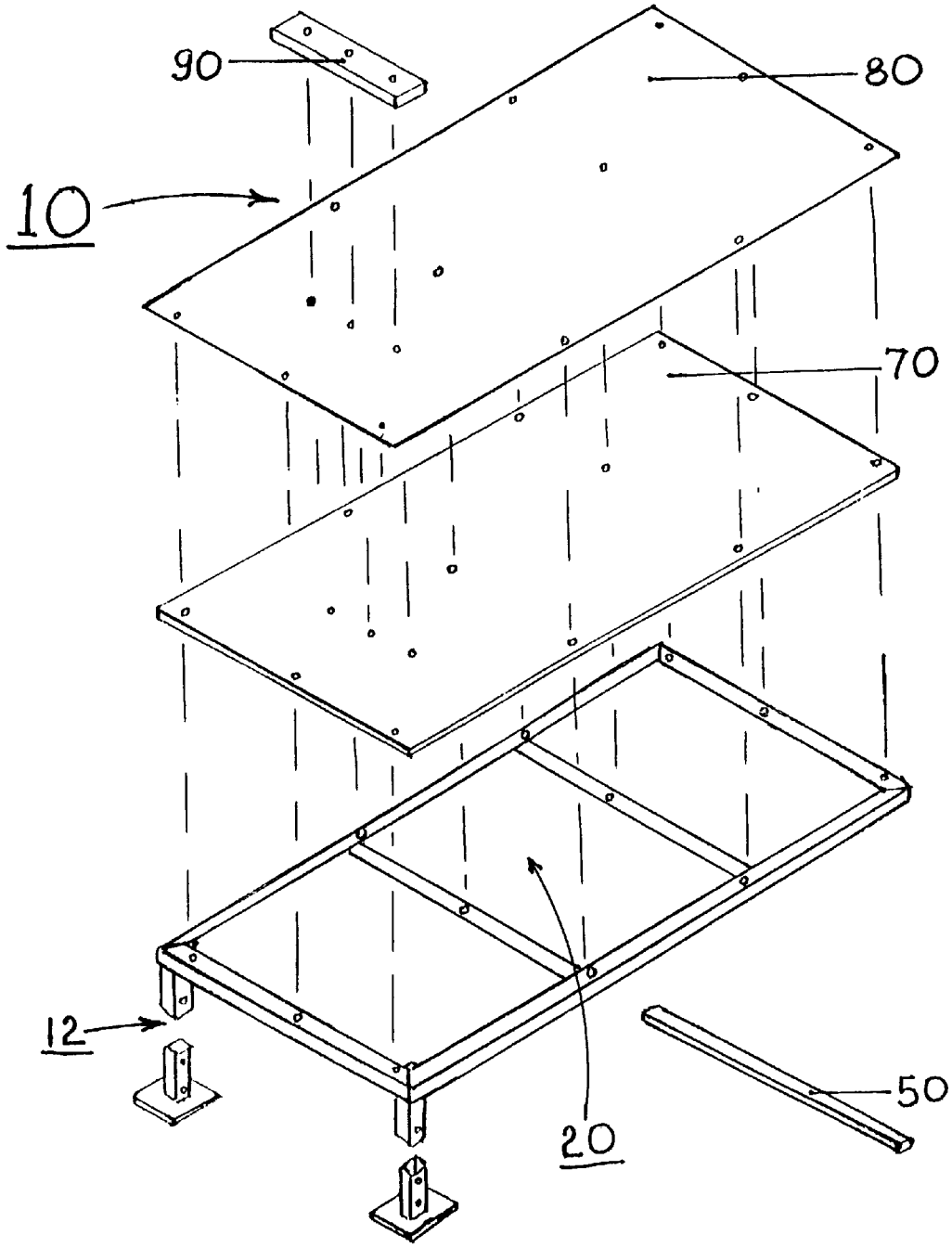
FIG. 2 is an exploded perspective view of one embodiment.

Referring to FIGS. 1-2, a portable pitching mound generally indicated by reference 10 includes a frame unit 20, male adjustable stabilizer tubing legs 30*a* & 30*b* with supporting base plates 32*a* & 32*b*, securing devices 34*a*, 34*b*, 36*a* & 36*b*, the legs 30*a* & 30*b* fitting in female receiver tubing 40*a* & 40*b*, anti-sink device 50, handle utility pull 60, surface base 70, turf 80, pitching rubber 90, and wheels 100*a* & 100*b*.

The frame 20 is preferably made of solid steel angle iron although other materials such as square tubing, plastic, rubber, fiberglass, polymer, wood and the like may be used. Materials exhibiting greater resistance to corrosion or surface treatments to inhibit corrosion may be implemented as known to one skilled in the art. The frame 20 has two parallel angle iron bars 22*a* & 22*b* although more could be added. Another set of four parallel angle iron bars 24*a*, 24*b*, 24*c*, & 24*d*, although more or less could be used, are connected to and perpendicular to bars 22*a* & 22*b*.

The female receiver tubes 40*a* & 40*b* are mounted (preferably fixed) to the corners 26*a* & 26*b* of the frame 20. The surface base 70 is mounted on the frame 20. Presently treated plywood is the preferred surface base 70 although other materials, such as, for example, a fairly rigid rubberized material (or wood combined with such material), plastic, fiberglass and the like may be used. Turf 80 is mounted on surface base 70 preferably with carpet adhesive or liquid nails may be used. Turf 80 preferably is a known synthetic turf material although other materials such as, but not limited to, a knitted nylon, Astroturf, woven fiber, carpet, or plastic may be implemented. The pitching rubber 90 is placed on top of the turf 80 and secured into the surface base 70. The handle utility pull 60 is preferably mounted to the frame section 24*a*. The handle utility pull 60 shown is a U-shaped handle although other types of handles or pulling devices, such as a rope, may be used. The anti-sink device 50 is preferably somewhat flat, having some width, and is mounted directly underneath the frame part 24*a*. The anti-sink device 50 is preferably made of hot roll strip. When the pitching mound 10 is to be used indoors, it is preferable to cover the base plates 32*a* & 32*b* and the anti-sink device 50 with a flexible anti-slip material so as to prevent shifting along the floor and to prevent scratching of the floor surface.

Referring to FIG. 2, illustrated are the preferred drilling locations used to secure the frame 20 to the surface base 70 to the turf 80 to the rubber 90 with carriage bolts and hex bolts as the preferred securing devices but others may be used as well as many other alternative drilling securing locations. The anti-sink device 50 is secured to frame 20 by any known means such as, for example, welding.

Figure 3:
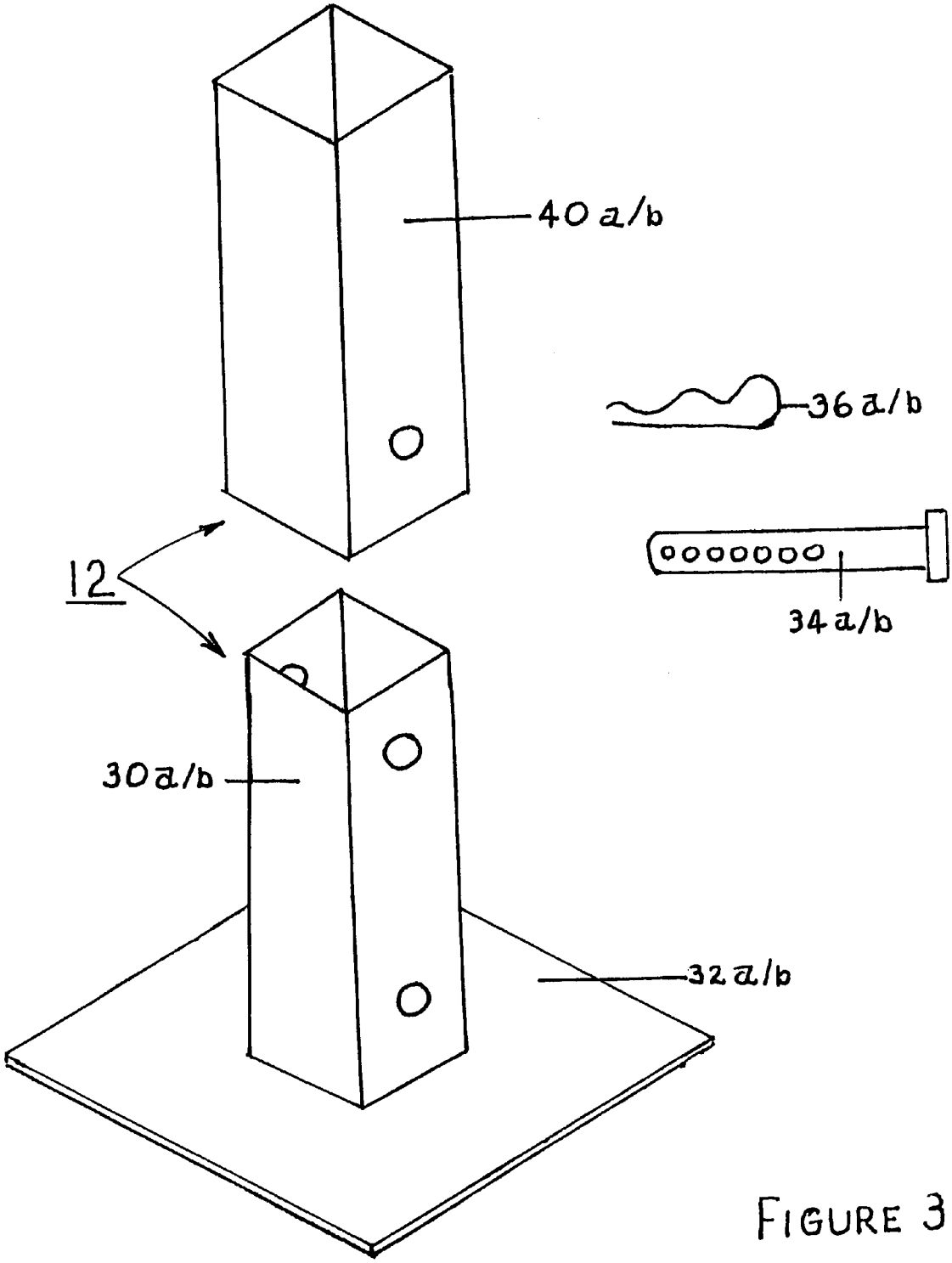
FIG. 3 is an exploded perspective view of a height adjustment mechanism.

Referring to FIG. 3, the height and/or slope setting mechanism 12 is illustrated. In the embodiment shown, male stabilizer tube legs 30*a/b* are respectively attached to the base plates 32*a/b* with the female receiver tubes 40*a/b* respectively seated over the male stabilizer tube legs 30*a/b* and secured in place by devices 34*a/b* & 36*a/b*, preferably clevis and bridge pins but others may be used. Another embodiment of a height and/or slope setting mechanism 12 may be used, such as, for example, circular tube legs (not shown) or molded plastic pieces having insertible extension members (not shown).

The height adjustment feature is critical. In the embodiment shown, as best realized by referring to FIG. 3, the back end 14 (see FIG. 4) of the portable indoor-outdoor pitching mound 10 may be set at a height of six inches above the ground by securing the female receiver tubing 40*a* & 40*b* via pins 34*a/b* inserted through the holes in such tubing and through the lower-most holes through respective male adjustable stabilizer tubing legs 30*a* & 30*b*, followed by locking the clevis pins 34*a/b* in place with bridge pins 36*a/b*. Alternatively, the portable indoor-outdoor pitching mound 10 may be set at a height of ten inches above the ground at back end 14 by securing the female receiver tubing 40*a* & 40*b* via pins 34*a/b* inserted through the holes in such tubing and through the upper-most holes through respective male adjustable stabilizer tubing legs 30*a* & 30*b*, followed by locking the clevis pins 34*a/b* in place with bridge pins 36*a/b*. Other height adjustment settings may be implemented as dictated by user needs or league rules. By way of example, a user may desire or need a height setting of four inches but desire adjustability to heights of six, eight, ten and twelve inches above the ground in which case more holes at appropriate heights could be added and the lengths of legs 30*a/b* and 40*a/b* could be changed as desired.

Figure 4:
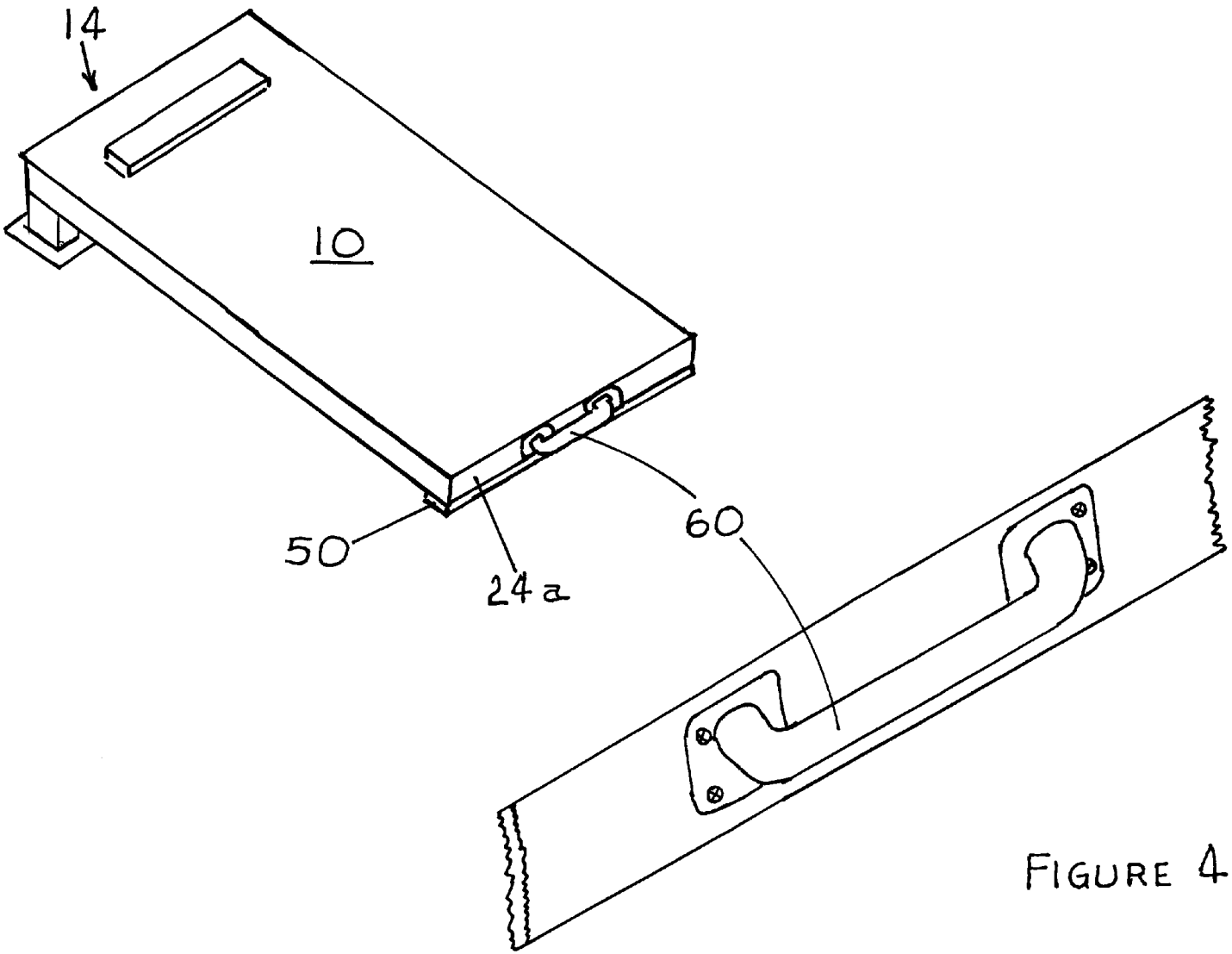
FIG. 4 is a perspective view of an assembled embodiment showing an enlarged view of a handle utility pull.

Referring to FIG. 4, illustrated is the handle utility pull 60 secured to the frame section 24*a*. Anti-sink device 50 is attached directly under angle iron bar 24*a*.

Figure 5:
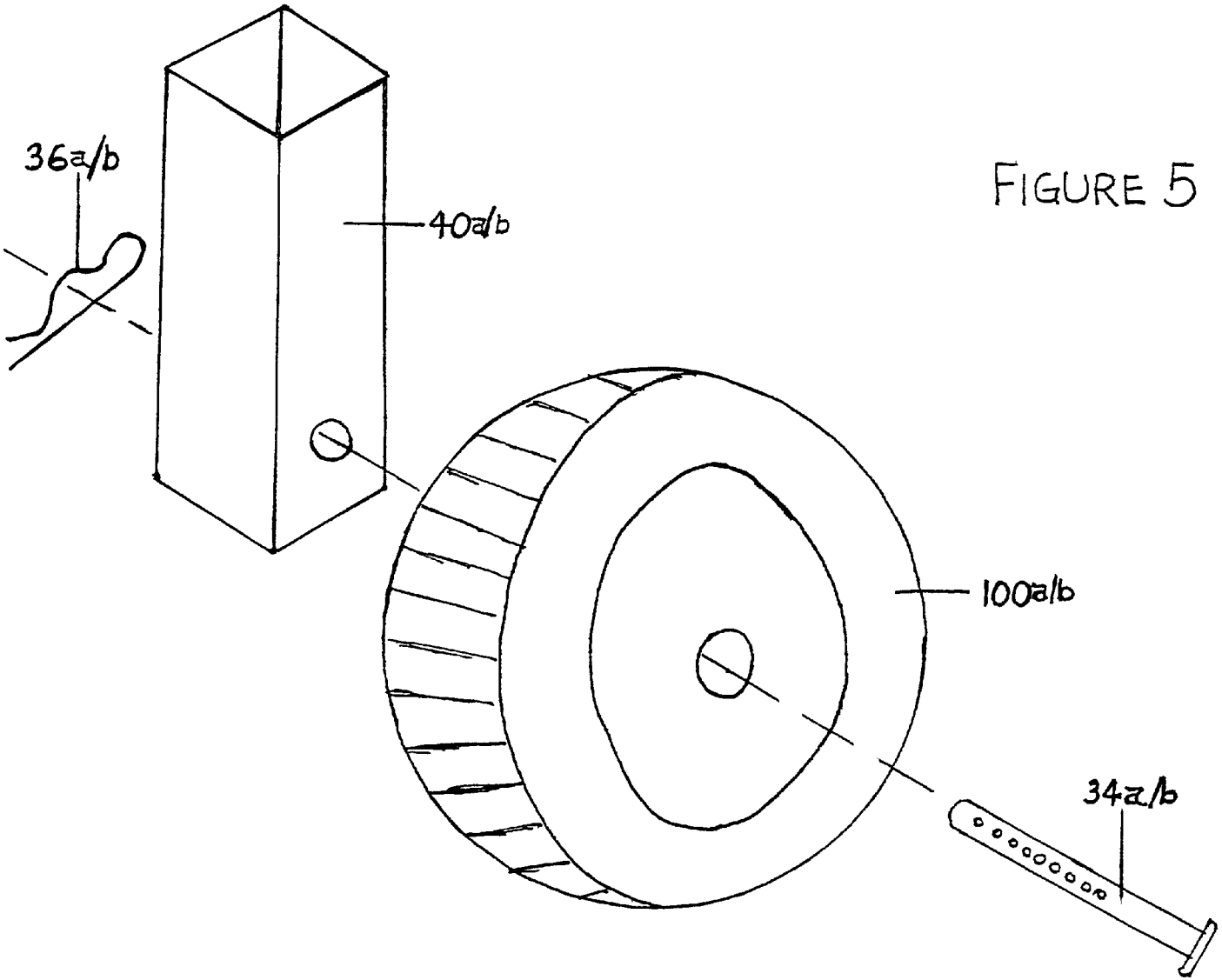
FIG. 5 is an exploded perspective view a wheel mounting system.

Referring to FIG. 5, illustrated are wheels 100*a/b* for mobility of the mound 10. The wheels 100*a/b* are respectively pinned to the female receiver tubes 40*a/b* by inserting the devices 34*a/b* through the center hole of the wheels 100*a/b* and the holes through the female receiver tubes 40*a/b*. The devices 34*a/b* is locked in place by devices 36*a/b* (bridge pins shown). Other types of wheels may be implemented into the mound 10, such as, for example, wheels fixed at the back end 14 of the mound 10 which may only engage the ground when the mound 10 is tilted back (back end 14 toward the ground) using handle utility pull 60.

Stabilization members (not shown) may be added to help stabilize the portable indoor-outdoor pitching mound 10 and are preferable attached to the frame unit 20.

Figure 6:
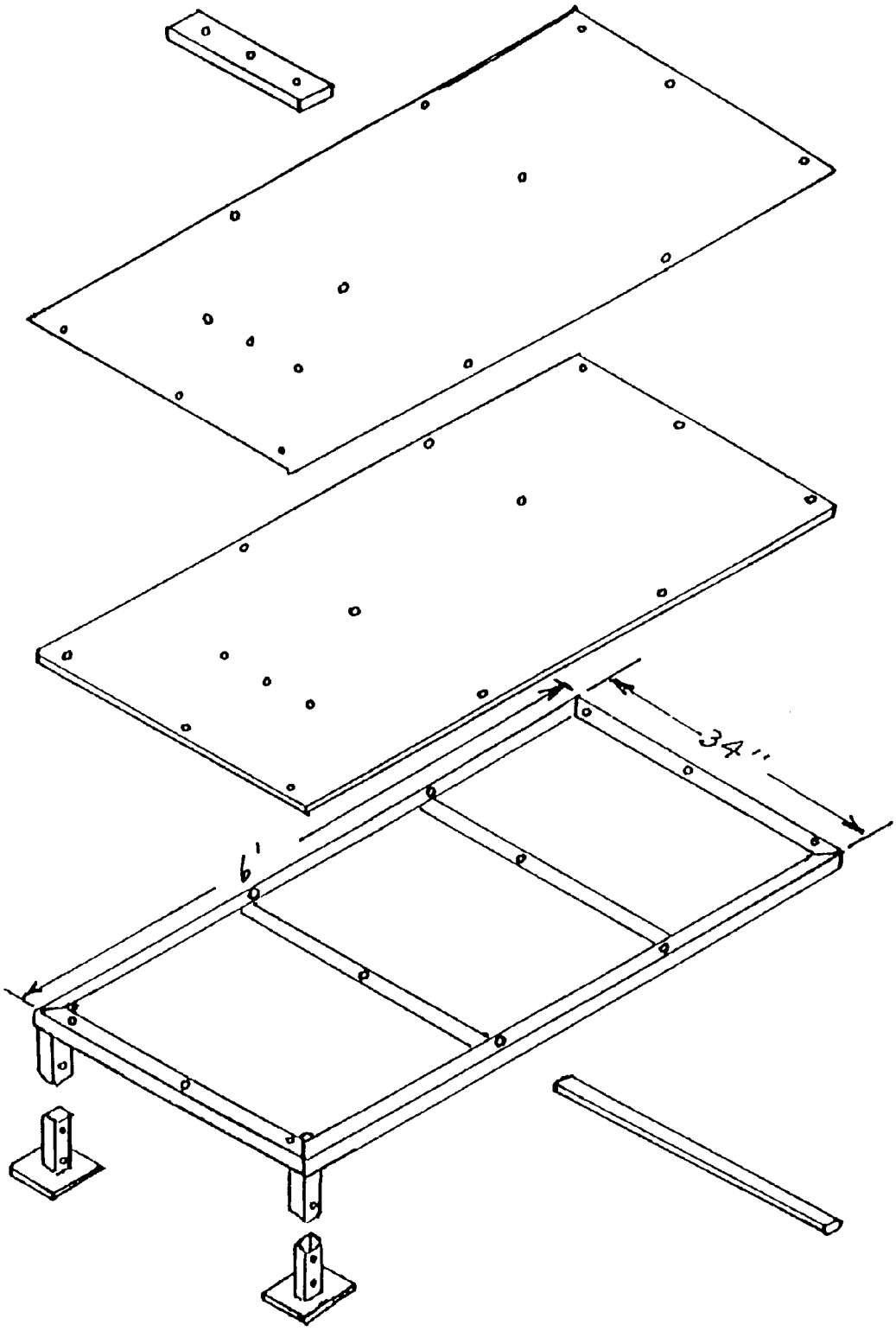
FIG. 6 is similar to FIG. 1 but represents certain preferred dimensions.
Figure 7:
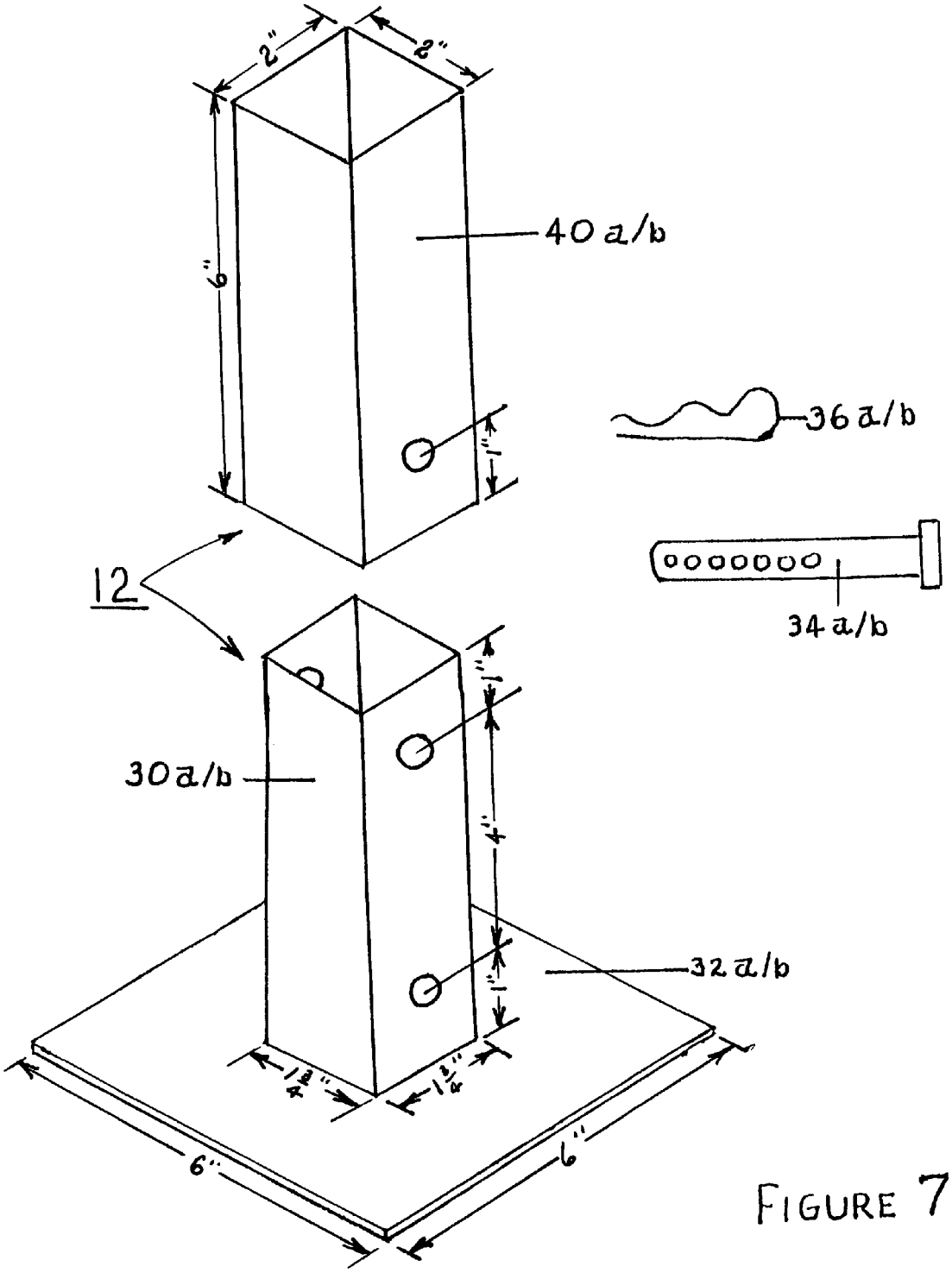
FIG. 7 is similar to FIG. 3 but represents certain preferred dimensions.

Referring to FIGS. 6 & 7, illustrate the preferred dimensions used to construct the pitching mound 10 but many other arrangements, sizes, and dimensions may be used and these drawings should not be interpreted to limit the scope or construction of the pitching mound 10.

The invention claimed is:

1. An apparatus for use in pitching a ball, comprising:

a pitching mound wherein the pitching mound includes a frame;

a base connected to the frame;

a turf connected to said base;

a pitching rubber connected to said base;

an anti-sink device connected to the frame; a handle utility pull connected to the frame;

a first female receiver tube and a second female receiver tube connected to the frame, each having a hole for height adjustment and wheel attachment;

a first male stabilizer leg and a second male stabilizer leg seated respectively in the first female receiver tube and the second female receiver tube; the first male stabilizer leg and the second male stabilizer leg each having at least two holes for height adjustment purposes to position an end of said pitching mound between 6 inches to less than 12 inches from the ground surface; the first male stabilizer leg and the second male stabilizer leg each respectively have a supporting base plate attached respectively at a lower end of the first male stabilizer leg and the second male stabilizer leg;

a first securing device and a second securing device passable through the holes;

a first bridge pin and a second bridge pin respectfully attachable to said first securing device and said second securing device; and a first wheel and a second wheel connectable respectively to the first female receiver tube and the second female receiver tube.

2. A method for practicing pitching of a ball utilizing the device of claim 1, comprising the steps of:

rolling the pitching mound with wheels to position the pitching mound for pitching;

replacing the wheels with stabilizer legs; and adjusting the height of the pitching mound to position the pitching mound for pitching.

* * * * *